United States Patent [19]

Lewis

[11] Patent Number: 4,733,924

[45] Date of Patent: Mar. 29, 1988

[54] COMBINATION PACKING CASE AND DESK

[76] Inventor: Donald C. Lewis, 1815 Clement Ave., Alameda, Calif. 94501

[21] Appl. No.: 424,394

[22] Filed: Sep. 27, 1982

[51] Int. Cl.[4] ..... A47B 83/00

[52] U.S. Cl. ..... 312/237; 190/11; 312/235 A; 312/241; 312/308

[58] Field of Search ..... 297/139, 140, 239; 108/33, 50; 312/237, 235, 308, 241; 206/216; 190/11

[56] References Cited

U.S. PATENT DOCUMENTS

| | | | |
|---|---|---|---|
| D. 159,534 | 8/1950 | Raichert | 297/140 X |
| 1,166,988 | 1/1916 | Hinkson | 190/40 |
| 2,547,754 | 4/1951 | Herrick | 108/33 X |
| 2,566,954 | 9/1951 | Murray | 108/50 X |

*Primary Examiner*—Joseph Falk

*Attorney, Agent, or Firm*—Harris Zimmerman; Howard Cohen

[57] ABSTRACT

A combination packing case and desk includes a shelf unit adapted to secure a plurality of articles during shipping. A hollow seating member having an open bottom is adapted to be received about the upper portion of the shelf unit to protect the articles therein. An outer casing is provided with an open bottom and is adapted to be received about the shelf unit-seating member assembly in fully enclosed fashion. At the shipping destination, the outer casing comprises a base upon which the shelf unit is supported to form a desk. The seating member may be used in conjunction with the desk for tasks involving the articles shipped in and supported on the shelf unit.

14 Claims, 4 Drawing Figures

COMBINATION PACKING CASE AND DESK

BACKGROUND OF THE INVENTION

In the field of shipping and freight handling, it is common practice to employ sophisticated protective packaging for fragile articles such as electronic components and the like. Such articles often must be protected not only from shock and impact, but also from static electricity, dust, moisture, and other contaminants. As a result, the shipping containers used for delicate electronic articles are often well designed, thoroughly engineered enclosures. These enclosures, which are generally very successful at protecting their contents, represent a significant expenditure in materials as well as in design effort.

When such a shipping container reaches its destination, it is a common practice for the components to be removed and tested to assure that they survived their journey unscathed. The shipping container, often comprising combinations of wooden supports, corrugated enclosures, and foam packing members, are usually considered refuse and destroyed. Hence a significant expenditure in materials and design is wasted after a minimal use. Indeed, it is not uncommon for the cost of packaging of an item to exceed the value of the item, even though the packaging is destroyed and the item is intended for long-term use.

The following United States Patents comprise the closest known prior art: U.S. Pat. Nos. 327,749, 1,385,094, 652,784, 1,501,440, 722,286, 2,213,985, 909,091, 2,604,959.

SUMMARY OF THE PRESENT INVENTION

The present invention generally comprises a packing and shipping container which is adapted to protect delicate electronic components and the like during shipping and handling procedures. A salient feature of the packing container is that at the final shipping destination, the container may be used as a desk to support and display the components that have been shipped therein. Thus the materials and design effort involved in the packing container combine to form a structure which is permanent and reusable, making far better use of the materials and offering far more to the customer purchasing the components within the packing case.

The combination packing case and desk includes a shelf unit adapted to secure a plurality of articles during shipping. A hollow seating member having an open bottom is adapted to be received about the upper portion of the shelf unit to protect and retain the articles therein. An outer casing comprising a hollow rectangular solid is provided with an open bottom and is adapted to be received about the shelf unit-seating member assembly in fully enclosed fashion. The outer casing includes a large cutout in one side thereof, the cutout being disposed in the shipping configuration in confronting impingement to one side of the shelf unit assembly. At the shipping destination, the outer casing is disposed open end downwardly to comprise a base upon which the shelf unit is supported to form a desk. The seating member is disposed adjacent to the cutout in the outer casing to comprise a stool adjacent to the leg opening cutout. The desk may be used for tasks involving the articles shipped in and supported on the shelf unit, or may be used separately with other items.

DESCRIPTION OF THE PREFERRED EMBODIMENT

The present invention generally comprises a packing and shipping case which is also usable as a desk to support and display the components which are shipped therein. With reference to the accompanying figures, the invention includes a shelf unit 11 which is adapted to receive and support a plurality of components, such as electronic components. These electronic components may comprise computer hardware, video hardware, stereophonic or audio hardware, radio communications equipment, or the like.

Figure 4:
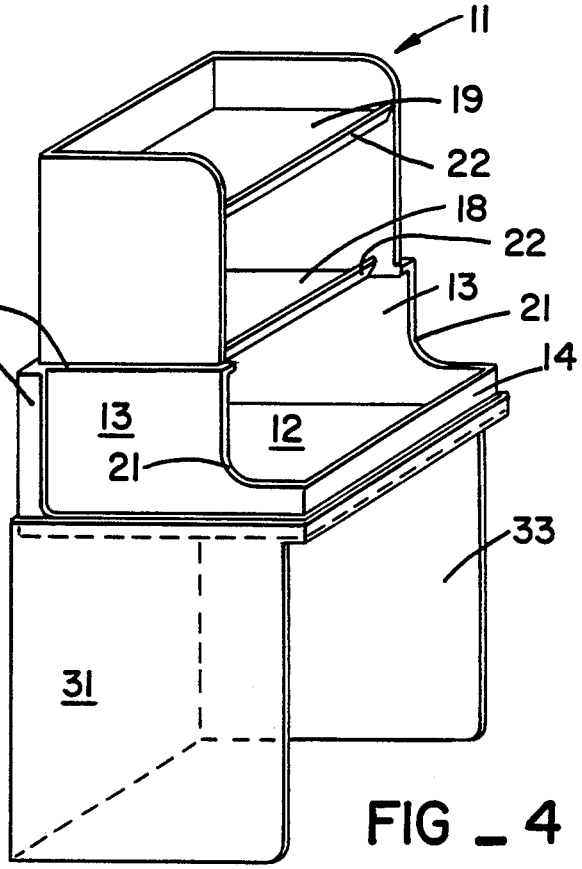
FIG. 4 is a perspective view of the shelf unit and base unit assembly of the present invention.

The shelf unit 11 includes a generally rectangular base panel 12, with opposed sides 13 extending orthogonally upwardly therefrom. The shelf unit also includes a short front panel 14, and a rear panel 16 equal in height to the sides. An inwardly stepped shoulder 17 is disposed at a medial height portion of the side panels and rear panel, and extends continuously thereabout. A pair of flanges 15 extends outwardly from the opposed sides 13, adjacent to the vertices thereof and extending below the shoulder 17 to the base panel 12, as shown in FIG. 4. A shelf member 18 extends between the side walls 13 adjacent to the shoulder 17 and vertically spaced from the base panel 12, and is also joined to the rear panel. Another shelf member 19 extends between the upper portions of the side panels 13 and the rear panel 16, and is vertically spaced from the shelf member 18. The side panels 13 include cut-out portions 21 adjacent to the front panel 14 to facilitate access to the volume defined by the side walls 13, the base panel 12, and the shelf 18, and the rear panels 16. Furthermore, the shelf members 18 and 19 are each provided with an upwardly extending lip 22 at the distal edges of the shelves to retain items on the respective shelf member during shipping and handling.

Figure 1:
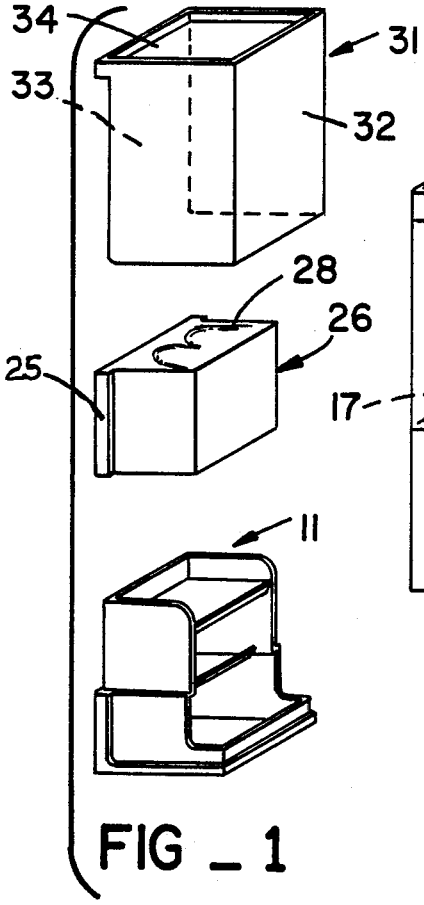
FIG. 1 is an exploded view of the components of the combination packing case and desk of the present invention.
Figure 2:
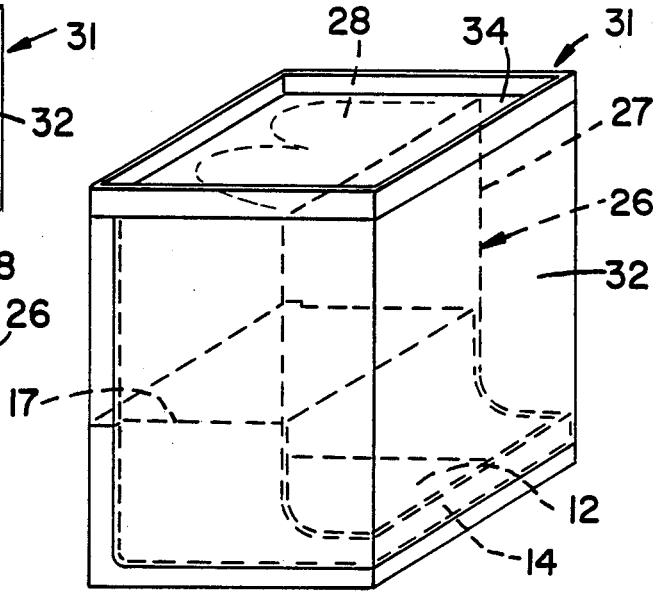
FIG. 2 is a perspective view of the shelf unit and seating member assembly of the present invention.
Figure 3:
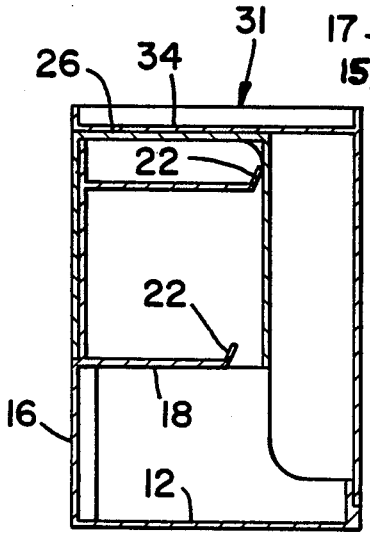
FIG. 3 is a cross-sectional side elevation of the shelf unit and seating member assembly as shown in FIG. 2.

The present invention also includes a seating member 26, as shown in FIGS. 1, 2, and 3. The seating member 26 comprises a generally rectangular, hollow member having an open bottom. The top panel 27 of the member 26 includes an anatomically contoured recess 28 which is provided to facilitate seating comfort. The side walls and end walls of the member 26 are provided with dimensions so that the member 26 may be received over and about the upper portion of the shelf unit 11, in close fit relationship, with the lower edges of the side walls and end walls of the member 26 impinging upon the stepped shoulder 17 of the shelf unit 11, as shown in FIGS. 2 and 3. In the disposition of FIGS. 2 and 3, the seating member 26 encloses the storage areas of the shelf members 18 and 19, and aids in protecting and retaining the items supported thereon. A pair of flanges 25 extend outwardly from the opposed sides of the seating member 26 adjacent to the vertices formed therewith by the rear panel of the seating member. The flanges 25 are generally colinear with the flanges 15 extending from the shelf unit, when the two members 11 and 26 are assembled. It should be noted that the periphery of the seating member is generally coplanar with the sides and rear panel of the shelf unit.

The present invention also includes an outer casing member 31, as shown in FIGS. 1 and 4. The outer casing member 31 includes a trio of side panels 32 disposed in a rectangular plan configuration. One of the sides 33 of the rectangle is open, the edges of the sides adjacent thereto being inset from the vertices, as seen in FIG. 4. A top panel 34 extends between the upper portions of all of the side walls 32 and is inset slightly below the top edge portions thereof. The plan configuration of the side walls 32 is arranged so that the outer casing member 31 may be received about the assembly consisting of the shelf unit 11 and the seating member 26. In this configuration, shown in FIG. 2, the open side 33 of the outer casing member 31 receives the shelf unit-seating member assembly therein. In such a disposition, the inset edges adjacent to the opening 33 impinge upon the colinear flanges 15 and 25, and the outer casing 31 forms a completely enclosed packing case, as shown in phantom line in FIG. 2. The sub-volumes within the packing case which do not contain components or other articles to be shipped, may be filled with resilient packing material or excelsior, as is known in the prior art.

The packing case itself, comprising the shelf unit, the seating member, and the outer casing member, is an extremely strong and rigid structure, due in part to the "nesting" elements which combine to strengthen each other. Furthermore, the shelf members 18 and 19 extending laterally within the packing case provide great resistance to deflection of the side walls of the packing case. Also, the flanges 15 and 25, in addition to the shoulder 17, aid in providing rigidity to the structure. It may be appreciated that the side walls of the outer casing 31 impinge upon the side walls 13 of the shelf unit and the side walls of the seating member 26.

A most salient feature of the present invention is that the components of the packing case are adapted to be used as a desk to support and display the components or articles which have been shipped in the packing case. As shown in FIG. 4, the outer casing 31, after it is removed from the package, may be disposed on a stable surface with the open end thereof extending downwardly. The shelf unit 11 may then be supported with the base panel 12 thereof resting upon the upper panel 34 of the outer casing 31. The inset of the upper panel 34 provides a "socket" in which the lower portion of the shelf unit 11 fits with minimal clearance. The shelf unit 11 is thus securely supported by the outer packing case 31.

The seating member 26, after it is disassembled from the packing container, may be disposed directly adjacent to the open side 33 of the outer packing case 31, to form a stool upon which an individual may sit. The individual sitting on the member 26 may address the components or items disposed on the shelves 18 and 19 and on the base panel 12, with the individual's legs extending through the opening 33 so that the individual may be closely proximate to the items supported on the shelf unit 11.

The packing container of the present invention is thus adapted to be reconfigured as a complete desk assembly, including base, shelf unit, and seating stool. The present invention thus provides an extremely convenient means of packaging, in that it also provides the end user of the packaged product with a means to support and display that product. Furthermore, all of the materials and effort which are devoted to creating the shipping container are not wasted, as is known in the prior art, but are instead re-used indefinitely and permanently. Thus the customer receiving the shipped articles also receives a furniture assembly of significant utility and value.

Indeed, it may be appreciated that the packing case may be used as a desk ensemble in conjunction with any items or articles which are convenient and desirable, and not necessarily the items shipped in the packing case.

In the present description the invention is depicted as generally rectangular in the configuration of the component parts and the assembly thereof. This is due to the perceived preferences of the shipping and freight industry, and not to any inherent limitation of the invention. Indeed, the inventive concept may be extended to any regular geometrical configuration or curvalinear geometry which permits the "nesting" configuration of the shelf unit, the seating member, and the outer casing.

I claim:

1. A combination packing case and desk, including; a shelf unit adapted to support and retain a plurality of articles during shipping, an outer casing including an opening dimensioned to receive said shelf unit therein, said outer casing being adapted to be separable from and removably secured about said shelf unit to form a fully enclosed case therewith, said outer casing including base end means for supporting said outer casing on a floor surface, and means at an end of said outer casing opposed to said base end means to secure and retain said shelf unit on said outer casing in supporting fashion, said shelf unit being variably positionable from the shipping position within said outer casing to a display position on said outer casing.

2. The combination packing case and desk of claim 1, further including a seating member, said seating member adapted to be received about a portion of said shelf unit and to be disposed within said outer casing.

3. The combination packing case and desk of claim 2, wherein said seating member includes a plan configuration substantially similar to the plan configuration of said shelf unit.

4. The combination packing case and desk of claim 3, wherein said outer casing includes opposed side panels and a rear panel extending therebetween, all of said panels defining a plan configuration substantially similar to and slightly larger than said plan configuration of said shelf unit.

5. The combination packing case and desk of claim 4, further including a leg opening portion in said outer casing, said leg opening portion comprising an open side opposed to said rear panel of said outer casing.

6. The combination packing case and desk of claim 4, wherein said means to engage and retain said shelf unit includes an end panel extending between said side and front panels adjacent to said opposed end of said outer casing and inset from the distal edge thereof to define a socket adapted to receive said shelf unit.

7. The combination packing case and desk of claim 1, wherein said shelf unit includes a base panel, opposed side walls extending generally orthogonally from said base panel, reinforcing means operatively connecting said side walls, and a rear panel extending between like edges of said side walls and connected to said reinforcing means.

8. The combination packing case and desk of claim 7, further including a shoulder inset extending along said side walls and said rear panel and disposed generaly parallel to said base panel.

9. The combination packing case and desk of claim 8, further including a seating member, said seating member having an opening therein adapted to receive the end portion of said shelf unit distal of said shoulder inset and oppsed to said base panel, said seating member opening abutting said shoulder inset.

10. The combination packing case and desk of claim 7, wherein said reinforcing means comprises a shelf member extending between said side walls of said shelf unit and disposed generally parallel to said base panel.

11. A combination packing case and desk, including; a shelf unit adapted to support and retain a plurality of articles during shipping, an outer casing including an opening dimensioned to receive said shelf unit therein, said outer casing being adapted to be removably secured about said shelf unit to form a fully enclosed case therewith, said outer casing including base end means for supporting said outer casing on a floor surface, means at an end of said outer casing opposed to said base end means to engage and retain said shelf unit in supporting fashion, said shelf unit being variably positionable from the shipping position within said outer casing to a display position on said outer casing, said shelf unit including a base panel, opposed side walls extending generally orthogonally from said base panel, reinforcing means operatively connecting said side walls, a rear panel extending between like edges of said side walls and connected to said reinforcing means, further including a shoulder inset extending along said side walls and said rear panel and disposed generally parallel to said base panel, and a seating member having an opening therein adapted to receive the end portion of said shelf unit distal of said shoulder inset and opposed to said base panel, said seating member opening abutting said shoulder inset.

12. The combination packing case and desk of claim 11, wherein said seating member is dimensioned to be received within said opening in said outer casing.

13. The combination packing case and desk of claim 11, further including a pair of flanges extending outwardly from said opposed sides of said shelf unit, said flanges being disposed adjacent to the vertices formed by said side walls and said rear panel.

14. The combination packing case and desk of claim 13, further including a pair of flanges extending outwardly from the sides of said seating member and disposed colinearly with said flanges on said shelf unit when assembled thereto, said colinear flanges engaging edge portions of said opening in said outer casing.

* * * * *